United States Patent [19]

Nagler et al.

[11] 3,945,163

[45] Mar. 23, 1976

[54] ABS THERMOPLASTIC CURB ASSEMBLY

[75] Inventors: William M. Nagler, Chicago, Ill.; Vernon Earl Woosley, Richmond, Va.

[73] Assignee: The Pate Company, Broadview, Ill.

[22] Filed: Mar. 1, 1974

[21] Appl. No.: 447,082

[52] U.S. Cl. ..... 52/219; 285/4; 285/44

[51] Int. Cl.[2] ..... E04D 13/14; E04G 15/06

[58] Field of Search ..... 52/219, 200, 58

[56] References Cited

UNITED STATES PATENTS 3,521,414 7/1970 Malissa ..... 52/219

3,807,110 4/1974 Kaminski ..... 52/219

*Primary Examiner*—James L. Ridgill, Jr.

*Attorney, Agent, or Firm*—Alter and Weiss

[57] ABSTRACT

An improved single unit multi-purpose roof penetrating curb. The curb is a plastic box with one large upstanding inverted cup-like section on the top surface thereof. Four smaller upstanding inverted cup-like sections are equidistantly spaced on the upper surface of the large cup-like section. The plastic box has a flange integrally attached at the base. The flange completely surrounds the perimeter of the box eliminating the need for separate flashing.

3 Claims, 4 Drawing Figures

ABS THERMOPLASTIC CURB ASSEMBLY

This invention relates to roof construction, and more particularly, to improved single unit multi-purpose self-flashing roof penetrating curbs.

This invention is an improvement on the MULTI-PURPOSE ROOF PENETRATING CURB, Ser. No. 304,851, filed on Nov. 8, 1972 now U.S. Pat. No. 3,807,110 which issued on Apr. 30, 1974, and is assigned to the assignee of this application.

Many different types of pipes or other objects, having generally circular cross-sections, traverse the roofs of buildings.

It has always been a problem to provide a waterproof seal at points of egress through a roof, as at the juncture between the pipe and the roof. Accordingly to present day construction methods, this waterproof seal is essentially made by opening a hole in the roof, setting a curb over the hole, passing a smaller diameter pipe through the curb, filling the peripheral clearance between the pipe and curb, and then covering the curb and adjacent roof with any suitable pitch. Roofing material is brought from the roof to cover the curb. This conventional method of construction not only is time consuming, but also is not the best way to provide waterproof seals.

One reason why this conventional method is used is that the pipes which pass through the roof have many different diameters. Thus, it has been most difficult to accomodate them with any prefabricated seal.

Many problems arise due to leakage through the pitch and roofing material, especially as they age, shrink and crack. The temperatures vary between baking in the hot summer sun and freezing during the cold winter night. Also, the seals must endure cold, wind, storm, snow, ice and the like. Of course, there is a constant degradation due to the continual assaults by rain and ice.

Usually, a flashing base surrounds the curb. The flashing base raises the roofing material to a level above the roof deck to obtain a reliable weatherproof seal where the pipe passes through the roof. The flashing base has a vertical plane, and the roof deck provides the horizontal plane. A biased or curved plate enables the roofing material to gradually change directions from horizontal to vertical, and thus, eliminates the 90° angle bend which would cause cracks and roof leaks.

To provide the flashing base pedestal and accomplish weather proofing, sheet metal box curbs which surround the pipe or other structure attached to or resting on the roof, are provided. However, even when the curbs are used, caps of tailored sizes and shapes must be made to order, in order to weatherproof the point of egress for the pipes.

Accordingly, an object of this invention is to provide a new and improved roof penetration curbs.

A related object of this invention is to provide roof penetration curb assemblies which can accomodate many different types and diameters of pipes.

A further object is to provide a single design which may be adapted to fit a wide variety of roofs, and to provide uniform curb construction with water-tight design.

Yet another object of this invention is to provide a multi-purpose roof penetration assembly wherein the curb is a single thermoplastic unit.

Still another object of this invention is to provide multi-purpose roof penetration curbs which are self-flashing.

Still another object of this invention is to provide molded plastic curbs which are adapted to utilize boots made from neoprene rubber for waterproofing at the egress points of the pipes.

In keeping with an aspect of the invention, these and other objects and features are accomplished by providing a single unit molded multi-purpose roof penetrating curb. The unit has a single large upwardly extending circular section on its upper surface with four equally spaced upwardly extending circular sections in the single large circular section. The large and small circular sections may accomodate different sized pipes, conduits, stacks or vents. Rubber boots are clamped to the pipes and to the outside walls of the sections to prevent leakage. The single unit curb includes a peripheral flange, thereby making the curb self-flashing.

A preferred embodiment of the invention may best be understood from a study of the following description when taken in conjunction with the attached drawings; wherein.

Figure 1:
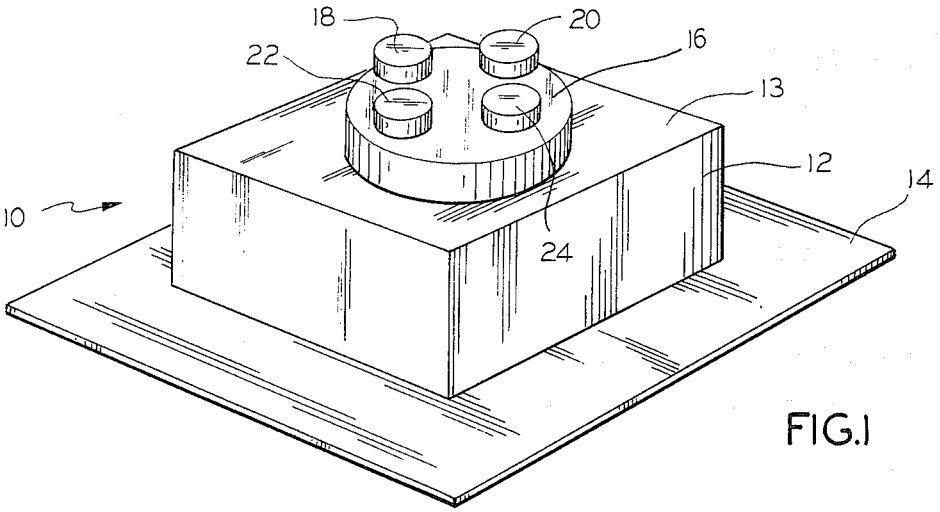
FIG. 1 is a pictorial view of the improved multi-purpose roof penetration curb.

FIG. 1 shows the improved roof penetration curb 10. The curb 10 is shown as a molded one piece device comprising four side walls, such as side wall 12. Integral to the four walls is a top side, referred to as a curb cap or cover 13. The complete curb 10 is shown as having the shape of a five-sided box-like structure.

The cap has an enlarged circular upstanding inverted cup-like section 16 shown centrally located therein. The enlarged upstanding circular section has four smaller circular sections 18, 20, 22 and 24, shown as equidistantly placed on the larger cup-like section 16. The top of any one or more of each of the circular sections, 16, 18, 20, 22 or 24 may be cut away to enable a pipe or pipes to pass therethrough. If no pipe is to pass therethrough, the cover is left intact. The pipes are weatherproofed by neoprene rubber boots (not shown) held in place adjacent the pipes by strap clamps that are clamped to the pipes and to the cylindrical forming side walls, such as side wall **16*a*.** The neoprene rubber boots are stepped from top to bottom and may be cut to accomodate the outside diameter of different sized pipes.

Figure 2:
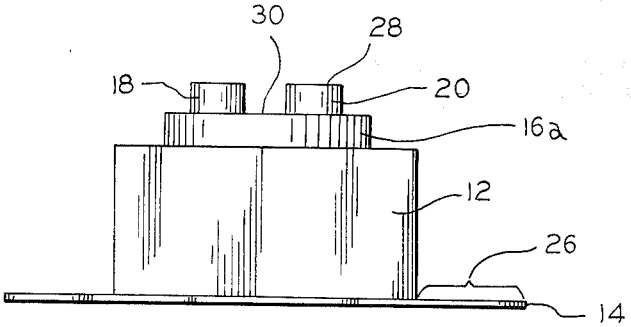
FIG. 2 is a side elevation view of the improved multi-purpose roof penetration curb.
Figure 4:
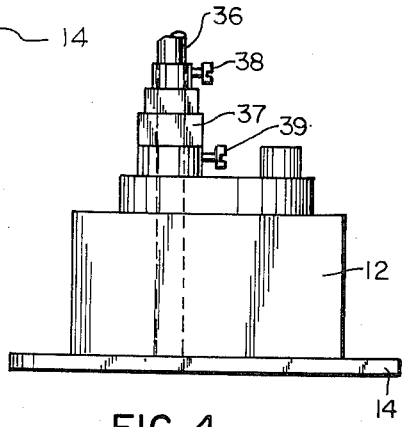
FIG. 4 is a side elevational view of the improved multi-purpose roof penetration curb showing a pipe running through the curb with a weatherproofing boot in place.
Figure 3:
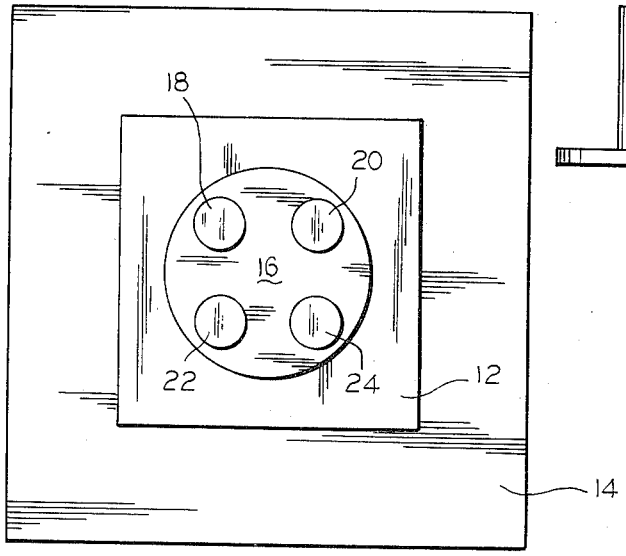
FIG. 3 is a plan view of the improved multi-purpose roof penetration curb.

As can be seen in FIGS. 1, 2 and 3, a flange 14 extends beyond the perimeter of the assembly curb 12. The flange 14 permits the curb assembly unit 10 to be self-flashing. The flange 14 is covered by roofing material. The upraised cup-like sections 16, 18, 20, 22, and 24, the cap 13, the sides such as side 12 and the flange 14 are preferrably all molded in one piece from ABS plastic and have acrylic coating.

For use then, the curb is molded in one piece. The roof material is stripped back; a hole is cut in the roof. The molded one piece curb is set on the roof surrounding the hole with the base flange extending under the roofing material. The necessary opening is made in the cap for the such as pipe 36 or pipes passing through the hole in the roof. A such as boot 37 or boots is attached to the pipe and the cap section of the curb with means, such as clamps 38 and 39, respectively, to waterproof the passageway.

It should be understood that while the side walls of the curb are shown as being vertical, they could be either canted or have canted sections. Similarly, the entire curb could be cylindrically shaped rather than cubical; and still provide the features of the unitary molded curb.

While the principles of the invention have been described above in connection with specific apparatus and applications, it is to be understood that this description is made only by way of example, and not as a limitation on the scope of the invention.

We claim:

1. A multi-purpose roof penetration curb to universally provide waterproof and weatherproof passage for pipes and the like passing through roofs, said curb comprising a unitary plastic five sided box-like structure having an integral base for resting said box-like structure directly on a roof over an opening in the roof, said five sides of the box-like structure comprising four upstanding side walls and an integral top section extending across said side walls, said top section being solid and non-apertured but having inchoate passageways therethrough, said inchoate passageways comprising a large circular cup-like section extending upward from said top section, a plurality of smaller circular cup-like sections integral to said larger cup-like section, said cup-like sections being sized to accomodate pipes of varying sizes and having upstanding cylindrical side walls, and said base comprising integral flange means extending outward from said four side walls serving as a base for said box-like structure, whereby said box-like structure is placed over an opening in the roof obviating the necessity of building a curb surrounding said opening.

2. The multi-purpose roof penetration curb of claim 1 wherein said box-like structure is fabricated from ABS plastic material with an acrylic coating.

3. The multi-purpose roof penetration curb of claim 1 wherein pipes pass through said cup-like structures and are waterproofed by rubber boots, said boots held to said pipes and to the cylindrical side walls by strap clamps, and said boots being stepped from bottom to top wherein said boots are cut to accomodate the outside diameter of different sized pipes.

* * * * *

UNITED STATES PATENT OFFICE

CERTIFICATE OF CORRECTION

PATENT NO. : 3,945,163

DATED : March 23, 1976

INVENTOR(S) : William M. Nagler and Vernon Earl Woosley

It is certified that error appears in the above-identified patent and that said Letters Patent are hereby corrected as shown below:

Col. 3, line 1: Insert the word --pipe-- between "for the" and "such as".

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*